US011086271B2

(12) United States Patent
Imai et al.

(10) Patent No.: US 11,086,271 B2
(45) Date of Patent: Aug. 10, 2021

(54) IMAGE FORMING APPARATUS DETERMINING COLOR MISREGISTRATION BASED ON VARIOUS TEMPERATURES

(71) Applicant: CANON KABUSHIKI KAISHA, Tokyo (JP)

(72) Inventors: Yuichiro Imai, Tokyo (JP); Daisuke Aruga, Abiko (JP); Yoshitaka Otsubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/590,962

(22) Filed: Oct. 2, 2019

(65) Prior Publication Data

US 2020/0110358 A1 Apr. 9, 2020

(30) Foreign Application Priority Data

Oct. 9, 2018 (JP) ..... JP2018-190757

(51) Int. Cl.
*G03G 21/20* (2006.01)
*G03G 15/00* (2006.01)
(Continued)

(52) U.S. Cl.
CPC ..... *G03G 21/20* (2013.01); *G03G 15/0131* (2013.01); *G03G 15/04036* (2013.01);
(Continued)

(58) Field of Classification Search
CPC ..... G03G 21/20; G03G 15/0131; G03G 15/04036; G03G 15/6561; G03G 15/011;
(Continued)

(56) References Cited

U.S. PATENT DOCUMENTS 5,828,925 A * 10/1998 Yoshizawa ..... G03G 15/011 399/39
9,014,601 B2 4/2015 Sato et al.
(Continued)

FOREIGN PATENT DOCUMENTS

JP 2003-207976 A 7/2003

OTHER PUBLICATIONS

U.S. Appl. No. 16/561,869, Akira Hamano Rin Ishikawa Takashi Tsujimura Yuichiro Imai Saimon Gokyu, filed Sep. 5, 2019.

*Primary Examiner* — Walter L Lindsay, Jr.
*Assistant Examiner* — Laura Roth
(74) *Attorney, Agent, or Firm* — Venable LLP

(57) ABSTRACT

The image forming apparatus stores a plurality of candidate formulas in a memory. Each of the candidate formulas is a formula for calculating a prediction formula for calculating a predicted value of the color misregistration amount based on an external exposure device temperature, which is a temperature of the atmosphere around the exposure device, an external machine temperature, and a heater temperature of a heater which heats the plurality of image forming units. The CPU determines the prediction formula from the plurality of candidate formulas according to the external exposure device temperature, the external machine temperature, and the heater temperature. The CPU calculates the predicted value of the color misregistration amount using the determined predicted formula, and performs a color misregistration correction according to the calculated predicted value.

6 Claims, 5 Drawing Sheets

(51) Int. Cl.
*G03G 15/01* (2006.01)
*G03G 15/04* (2006.01)

(52) U.S. Cl.
CPC ..... *G03G 15/5045* (2013.01); *G03G 15/6561* (2013.01); *G03G 15/04072* (2013.01); *G03G 2215/0158* (2013.01)

(58) Field of Classification Search
CPC ..... G03G 15/04072; G03G 2215/0158; G03G 15/5033; G03G 15/5045
See application file for complete search history.

(56) References Cited

U.S. PATENT DOCUMENTS

| | | | | |
|---|---|---|---|---|
| 10,126,689 | B2 | 11/2018 | Hamano et al. | |
| 2014/0064800 | A1* | 3/2014 | Sato | G03G 15/0189 399/301 |
| 2015/0117912 | A1* | 4/2015 | Kamiyama | G03G 15/0131 399/301 |
| 2016/0209795 | A1* | 7/2016 | Iwamoto | G03G 15/5054 |
| 2016/0252852 | A1* | 9/2016 | Nakachi | G03G 15/205 399/70 |
| 2017/0351206 | A1* | 12/2017 | Hamano | G03G 15/043 |
| 2020/0103812 | A1* | 4/2020 | Taniguchi | G03G 15/043 |

* cited by examiner

IMAGE FORMING APPARATUS DETERMINING COLOR MISREGISTRATION BASED ON VARIOUS TEMPERATURES

BACKGROUND OF THE INVENTION

Field of the Invention

The present disclosure relates to an image forming apparatus which forms a color image on a sheet by overlapping a plurality of different color images.

Description of the Related Art

The color image forming apparatus of an electronic photograph system includes two or more image forming units. Each image forming unit forms images of different colors for high-speed image forming processing. Each image forming unit includes a photoreceptor with which an image is formed. For example, on the photoreceptor, an electrostatic latent image is formed by an exposure process, and the electrostatic latent image is developed by a development process to form an image. An image forming apparatus transfers the image of each color formed in the photoreceptor of each image forming unit one by one on the recording material which is held on a conveyance belt in the image forming apparatus. Thus, full-color images are formed on the recording material. In this case, the image forming apparatus may sequentially perform a primary transfer of the images of the respective colors from the photoreceptor to an intermediate transfer member, then, collectively perform a secondary transfer of the images from the intermediate transfer member to the recording material.

The image forming apparatus described above includes a laser scanner in order to form the image on the photoreceptor. The laser scanner includes a deviation component and a drive source which drives the deviation component, in order to deflect the laser light from a light source. The laser scanner scans the photoreceptor by the laser light deflected by the deviation component to form an electrostatic latent image. The drive source generates heat by driving a deviation component. By generation of heat of the drive source, a change of a shape, a change of a position, and change of a posture may arise in the optical component in a laser scanner such as a lens and a mirror. These changes may cause a change in an irradiation position of the photosensitive member by the laser light. The change in the irradiation position results in a position shift when the images of the respective colors are superimposed, and as a result, a shift occurs in the image forming position on the recording material of each color (or on the intermediate transfer member). Such a shift in image forming position is hereinafter referred to as "color misregistration".

As to the color misregistration, there is known a method of detecting a color misregistration amount by forming a detection image for detecting color misregistration on the intermediate transfer member at a predetermined timing, and reading the detection image by a sensor to detect an amount of the color misregistration. The image forming apparatus adjusts the irradiation position of the laser light by controlling a starting timing of the image by laser light etc., according to the detected color misregistration amount to thereby correct the color misregistration. The color misregistration correction needs to be performed at an appropriate time interval or every predetermined number of printed sheets. However, forming of the detection image each time the color misregistration correction leads to increased downtime. Under these circumstances, there is provided a technique for correcting color misregistration without using the detection image by predicting the color misregistration amount from an in-machine temperature (i.e., a temperature in the image forming apparatus). In this case, the correspondence between the in-machine temperature and the amount of color shift is measured in advance.

U.S. Pat. No. 9,014,601 B2 discloses an image forming apparatus which performs a color misregistration correction by predicting the color misregistration amount from temperature measurement results of an exposure device and a photosensitive drum. Japanese Patent Application Laid-Open No. 2003-207976 discloses an image forming apparatus which performs the color misregistration correction by predicting the color misregistration amount from the measurement results of the in-machine temperature.

After the photoconductor has been used for a long time, in a high humidity environment, it becomes difficult to maintain charge for forming an electrostatic latent image. In order to prevent this, the photosensitive member is heated by a heater. By providing the heater between the photoconductor and the laser scanner, the surface of the photoconductor, on which the electrostatic latent image is formed, is efficiently warmed. In order to reduce the size of the image forming apparatus, the distance between the heater and the laser scanner is shortened.

In such a configuration, the laser scanner tends to be influenced by heat from the heater. Specifically, a housing of the laser scanner is deformed by the heat of the heater. For this reason, the irradiation position of the laser beam changes and the color misregistration occurs. The amount of color misregistration due to the heat from the heater is greater than the amount of color misregistration due to the heat generated by the drive source of the deflection member. Therefore, in the conventional method, an error between an actual color misregistration amount and the estimated color misregistration amount becomes large. One object of the present invention is to correct color misregistration with high accuracy in a configuration having the heater between the photosensitive member and the laser scanner.

SUMMARY OF THE INVENTION

An image forming apparatus includes a first image forming unit configured to form a first image of a first color, wherein the first image forming unit comprises a first photosensitive member; a first charging unit configured to charge the first photosensitive member; a first light source configured to expose the first photosensitive member charged by the first charging unit to form an electrostatic latent image, wherein the first light source is provided in a housing; and a first developing unit configured to develop the electrostatic latent image on the first photosensitive member with toner of the first color, a second image forming unit configured to form a second image of a second color which is different from the first color, wherein the second image forming unit comprises a second photosensitive member; a second charging unit configured to charge the second photosensitive member; a second light source configured to expose the second photosensitive member charged by the second charging unit to form an electrostatic latent image, wherein the second light source is provided in the housing; and a second developing unit configured to develop the electrostatic latent image on the second photosensitive member with toner of the second color, a transfer unit configured to transfer the first image and the second image on a sheet; a fixing unit configured to fix the first image and the second image to the sheet; a heater configured to heat the first photosensitive member and the second photosensitive member; a first temperature sensor provided in the housing; a second temperature sensor provided at an outside portion of the housing; a third temperature sensor, wherein a distance between the third temperature sensor and the first temperature sensor is greater than a distance between the second temperature sensor and the first temperature sensor; and a controller configured to detect, in a case where a detected temperature of the second temperature sensor does not exceed a detected temperature of the third temperature sensor by a predetermined temperature, a color misregistration based on a temperature detected by the first temperature sensor and a temperature detected by the second temperature sensor and a first detection condition; detect, in a case where the detected temperature of the second temperature sensor exceeds the detected temperature of the third temperature sensor by the predetermined temperature or more, the color misregistration based on the temperature detected by the first temperature sensor and the temperature detected by the second temperature sensor and a second detection condition which is different from the first detection condition; and control a relative position between a first image to be formed by the first image forming unit and a second image to be formed by the second image forming unit based on the detected color misregistration.

Further features of the disclosure will become apparent from the following description of exemplary embodiments (with reference to the attached drawings).

DESCRIPTION OF THE EMBODIMENTS

In the following, one embodiment of the present disclosure is described in detail with reference to the accompanying drawings.

Image Forming Apparatus

Figure 1:
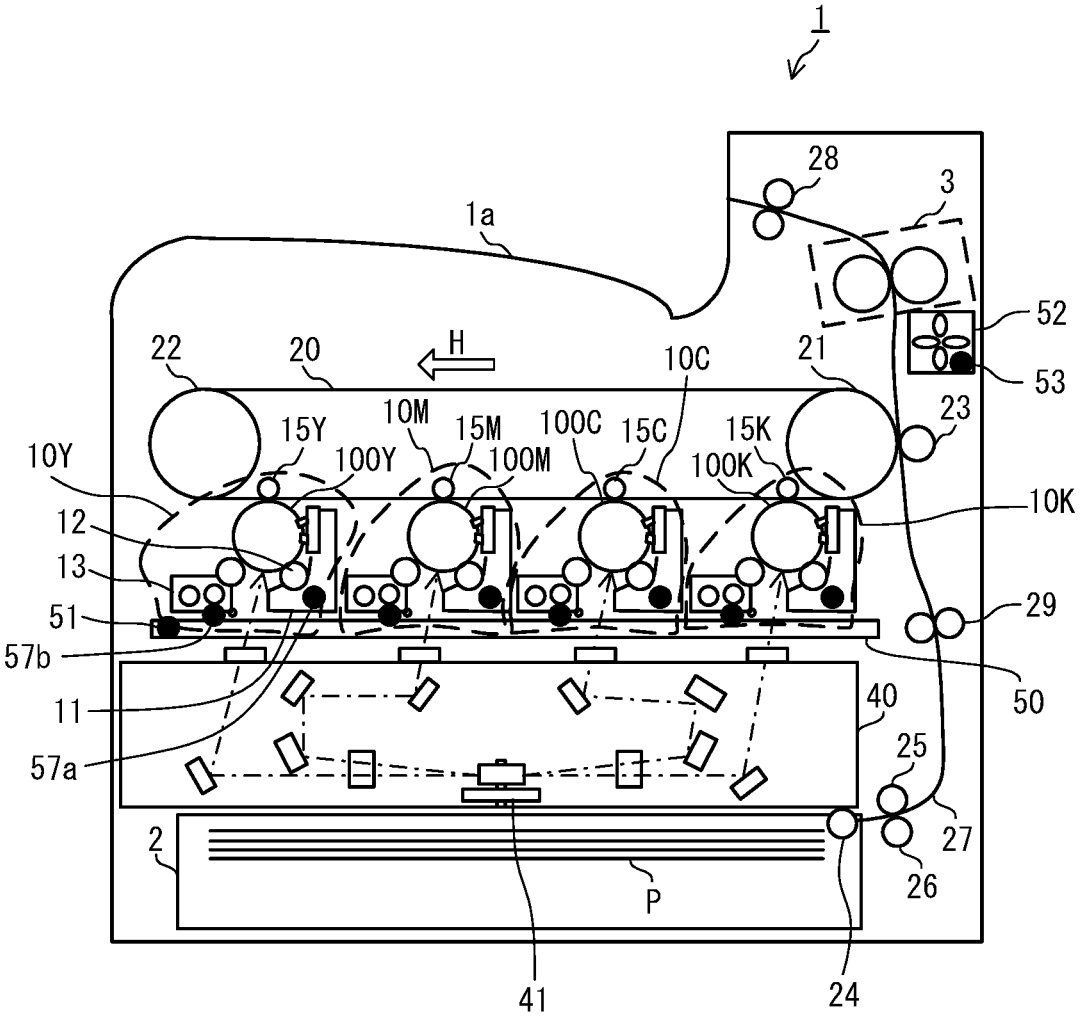
FIG. 1 is a configuration diagram of an image forming apparatus.

FIG. 1 is a configuration diagram of an image forming apparatus. This image forming apparatus 1 is a color laser beam printer. The image forming apparatus 1 includes four image forming units 10Y, 10M, 10C, and 10K, and a laser scanner, which is an exposure device 40, in order to form toner images of four colors, i.e., yellow (Y), magenta (M), cyan (C), and black (K). The image forming apparatus 1 includes an intermediate transfer belt 20 on which the toner images, which are formed by the image forming units 10Y, 10M, 10C, and 10K, are overlappingly transferred. The image forming apparatus 1 includes a feeding mechanism for feeding a recording material P on which the toner images transferred on the intermediate transfer belt 20 are collectively transferred. The image forming apparatus 1 includes a fixing device 3, which fixes a toner image on the recording material P.

The image forming units 10Y, 10M, 10C, and 10K are provided beneath the intermediate transfer belt 20, and form images (toner images) of corresponding colors. The image forming unit 10Y forms a yellow toner image. The image forming unit 10M forms a magenta toner image. The image forming unit 10C forms a cyan toner image. The image forming unit 10K forms a black toner image. Each of image forming units 10Y, 10M, 10C, and 10K has the same configuration. Here, the suffixes Y, M, C, and K respectively represent yellow, magenta, cyan, and black. In a case where a description is made for each color, the suffixes Y, M, C, and K are added to the end of the references. However, in a case where there is no need to individually explain a corresponding configuration for each color, the suffixes Y, M, C, and K at the end of the references are omitted.

The image forming unit 10 includes a photosensitive drum 100, which is a photoreceptor, a charger 12, a developing device 13, and a primary transfer roller 15. The charger 12 is provided in an image forming unit housing 11. The image forming unit housing 11 holds the photosensitive drum 100. In the image forming unit housing 11, an image forming unit temperature sensor 57*a* is provided. A surface of the photosensitive drum 100 is uniformly charged by the charger 12. The exposure device 40 irradiates the charged surface of the photosensitive drum 100 with laser light modulated according to image data representing an image to be formed. As a result, an electrostatic latent image is formed on the surface of the photosensitive drum 100.

The exposure device 40 is provided beneath the image forming units 10Y, 10M, 10C, and 10K, with a heater 50 intervening therebetween. The exposure device 40 is shared by the image forming units 10Y, 10M, 10C, and 10K. The exposure device 40 is configured to irradiate the photosensitive drums 100Y, 100M, 100C, and 100K with laser light. The exposure device 40 includes four semiconductor lasers 42Y, 42M, 42C, and 42K (FIG. 2A), each of which emits laser light modulated according to image data of each color, and includes deflection member (polygon mirror) 41, which rotates at high speed to scan the laser light of these four optical paths along the axial direction of the photosensitive drum 100. The laser light scanned by the polygon mirror 41 is guided in an optical system in the exposure device 40 to travel through a predetermined path, and then, the laser light is output from an upper part of the exposure device 40 to expose (irradiate) each of the photosensitive drums 100Y, 100M, 100C, and 100K.

In addition, the heater 50, which is provided between the image forming unit 10 and the exposure device 40, is provided to maintain a temperature of the photosensitive drum 100 within a target temperature range. The heater 50 includes a heater temperature sensor 51 for detecting a temperature of the heater 50. The heater temperature sensor 51 detects the temperature of the heater 50. The temperature (heater temperature) of the heater 50 is controlled, according to the detection result of the heater temperature sensor 51, to be within a range of target temperature.

The developing device 13 forms a toner image on the photosensitive drum 100 by developing the electrostatic latent image with a developer (toner). A toner image of yellow is formed on the photosensitive drum 100Y. A toner image of magenta is formed on the photosensitive drum 100M. A toner image of cyan is formed on the photosensitive drum 100C. A toner image of black is formed on the photosensitive drum 100K. The developing device 13 includes an image forming unit temperature sensor 57*b*. At least one of the image forming unit temperature sensor 57*a* and the image forming unit temperature sensor 57*b* is provided.

The toner image formed on the photosensitive drum 100 is transferred to the intermediate transfer belt 20 by the primary transfer roller 15. The primary transfer roller 15 is arranged at a position facing the photosensitive drum 100 with the intermediate transfer belt 20 interposed therebetween. By applying a predetermined transfer bias voltage to the primary transfer roller 15, an electric field is formed between the photosensitive drum 100 and the primary transfer roller 15. Because the toner image on the photosensitive drum 100 is charged, a Coulomb force is generated by the electric field between the photosensitive drum 100 and the primary transfer roller 15. Therefore, the toner image is transferred to the intermediate transfer belt 20.

The intermediate transfer belt 20 is a transfer member in a form of an endless belt, and is wound around a pair of belt conveyance rollers 21 and 22. As the intermediate transfer belt 20 is rotated in a rotation direction H by the belt conveyance rollers 21 and 22, the toner images on the photosensitive drum 100 are sequentially transferred and superimposed on the intermediate transfer belt 20. The toner images are transferred in the order of the photosensitive drum 100Y, the photosensitive drum 100M, the photosensitive drum 100C, and the photosensitive drum 100K. By superimposing the toner images of the respective colors, a full color toner image is formed on the intermediate transfer belt 20. At this time, if there is a deviation in a formation position of the toner image (transfer position), a change of tint occurs and the image of a desired color is not formed. This is color misregistration.

The intermediate transfer belt 20 rotates to convey the transferred toner image to the belt conveyance roller 21. A secondary transfer roller 23 is provided at a position opposite to the belt conveyance roller 21 with the intermediate transfer belt 20 therebetween. A transfer unit which transfers the toner image on the recording material P is formed by the belt conveyance roller 21 and the secondary transfer roller 23. The recording material P is inserted between the intermediate transfer belt 20 and the secondary transfer roller 23, and the toner image is transferred from the intermediate transfer belt 20.

The recording material P is fed through the image forming apparatus 1 by a feeding mechanism. The feeding mechanism includes a paper feed cassette 2, a conveyance path 27, a pickup roller 24, a paper feed roller 25, a retard roller 26, a registration roller 29, a secondary transfer roller 23, and a discharge roller 28. The recording material P is fed from the paper feed cassette 2. The toner image is transferred on the recording medium by the transfer unit while being conveyed through the conveyance path 27. Further, the recording medium is discharged, via the fixing device 3, to the discharge tray 1*a*. The fixing device 3 is provided in the conveyance path 27.

The paper feed cassette 2 accommodates the recording material P and is disposed at a bottom of the image forming apparatus 1. The paper feed cassette 2 is set in the image forming apparatus 1 by pushing the same into a lower part of a housing of the image forming apparatus from a side surface of the housing. The pickup roller 24 is provided on an upper side of the paper feed cassette 2, which is set to the image forming apparatus. The pickup roller 24 pulls out the recording material P stored in the paper feed cassette 2 to feed it to the conveyance path 27. The paper feed roller 25 and the retard roller 26 prevent the fed recording material P from being fed in an overlapped state, thereby the recording material P is fed one by one to the conveyance path 27.

The conveyance path 27 is provided such that the recording material P is conveyed bottom to top along the right side surface in the drawing in the housing of the image forming apparatus 1. The recording material P is conveyed, by the paper feed roller 25 and the retard roller 26, one by one through the conveyance path 27 to the registration roller 29. The registration roller 29 corrects skew of the recording material P with respect to a conveyance direction of the same. The registration roller 29 conveys the recording material P to the transfer unit according to a timing at which the toner image formed on the intermediate transfer belt 20 is conveyed to the transfer unit. The recording material P on which the toner image is transferred at the transfer unit is conveyed to the fixing device 3 by the secondary transfer roller 23.

The fixing device 3 heats and pressurizes the recording material P to fix the toner image on the recording material P. As a result, an image is formed on the recording material P. The recording material P on which the image is formed is discharged to the paper discharge tray 1*a* by the discharge roller 28. The image is formed on the recording material P as described above.

The image forming apparatus 1 includes a fan 52 for taking air outside the housing (outside the image forming apparatus 1) into the housing (inside the image forming apparatus 1). A temperature inside the image forming apparatus 1 (internal machine temperature) is lowered by the fan 52. In the vicinity of the fan 52, an outside machine temperature sensor 53 for detecting a temperature outside the image forming apparatus 1 (external machine temperature) is provided. The temperature sensor 53 is provided at a position different from the heater temperature sensor 51 and an external exposure device temperature sensor 56*a* (hereinafter temperature sensor 56*a*) and an external exposure device temperature sensor 56*b* (hereinafter temperature sensor 56*b*).

Exposure Device

Figure 2A:
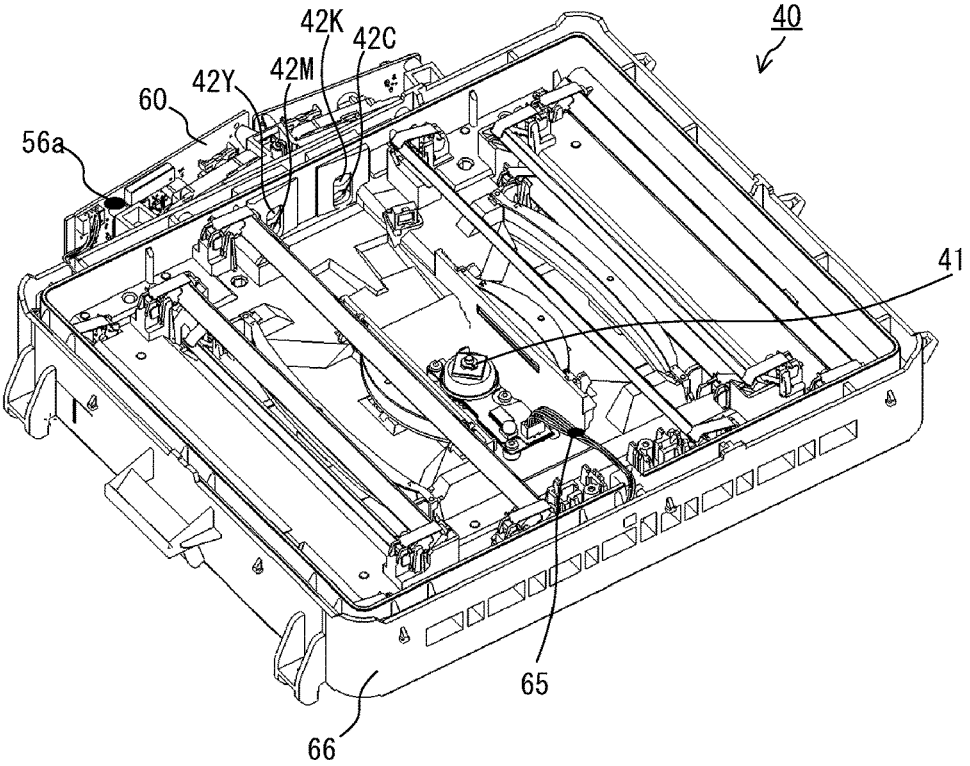
FIG. 2A and FIG. 2B are configuration diagrams of an exposure device.
Figure 2B:
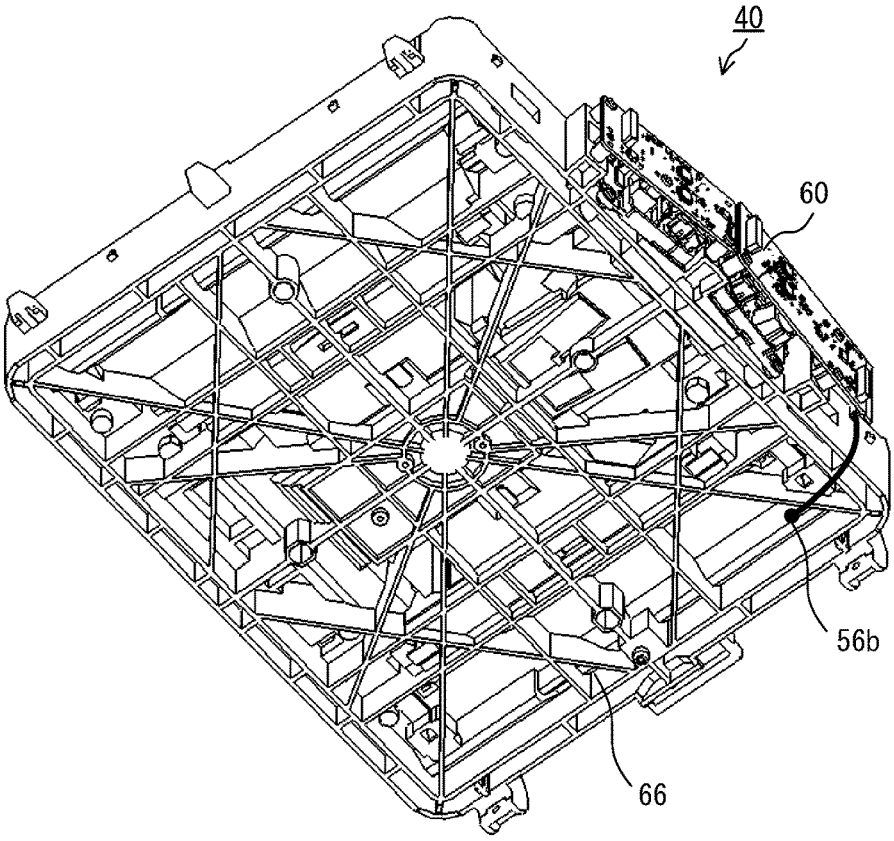

FIG. 2A and FIG. 2B are configuration diagrams of the exposure device 40. FIG. 2A is a configuration diagram of the inside of the exposure device 40. FIG. 2B shows a bottom of the exposure device 40. On the exposure device 40, a circuit board 60, which performs a light emitting control of semiconductor lasers 42Y, 42M, 42C, and 42K, is provided in a housing 66. The housing 66 may be a product made of resin or metal. In the circuit board 60, the temperature sensor 56*a* for detecting a temperature outside the exposure device 40 is provided. In the housing 66, a polygon mirror 41 is provided substantially at the center of the housing 66. In the vicinity of the polygon mirror 41 inside the housing 66, an internal exposure device temperature sensor 65 (hereinafter "temperature sensor 65") for detecting a temperature inside the exposure device 40 is provided. A bottom of the exposure device 40 has a shape for strengthening the structure of the housing 66. At a valley portion of the bottom portion, the temperature sensor 56*b* for detecting a temperature outside the exposure device 40 is provided.

The temperature sensors 56*a* and 56*b* measure an ambient temperature around the exposure device 40 (external exposure device temperature). The temperature sensors 56*a* and 56*b* are provided at the exposure device 40 to detect a temperature of the exposure device 40. The temperature sensor 65 measures a temperature inside the exposure device 40 (internal exposure device temperature). The internal exposure device temperature rises due to heat generated by a motor (not shown) upon operating the polygon mirror 41. It is noted that the temperature sensor 56*b* may be provided at a side surface of the housing 66, or provided between the housing 66 and the heater 50, or the like. It is necessary to provide at least one of the temperature sensor 56*a* and the temperature sensor 56*b*.

Controller

Figure 3:
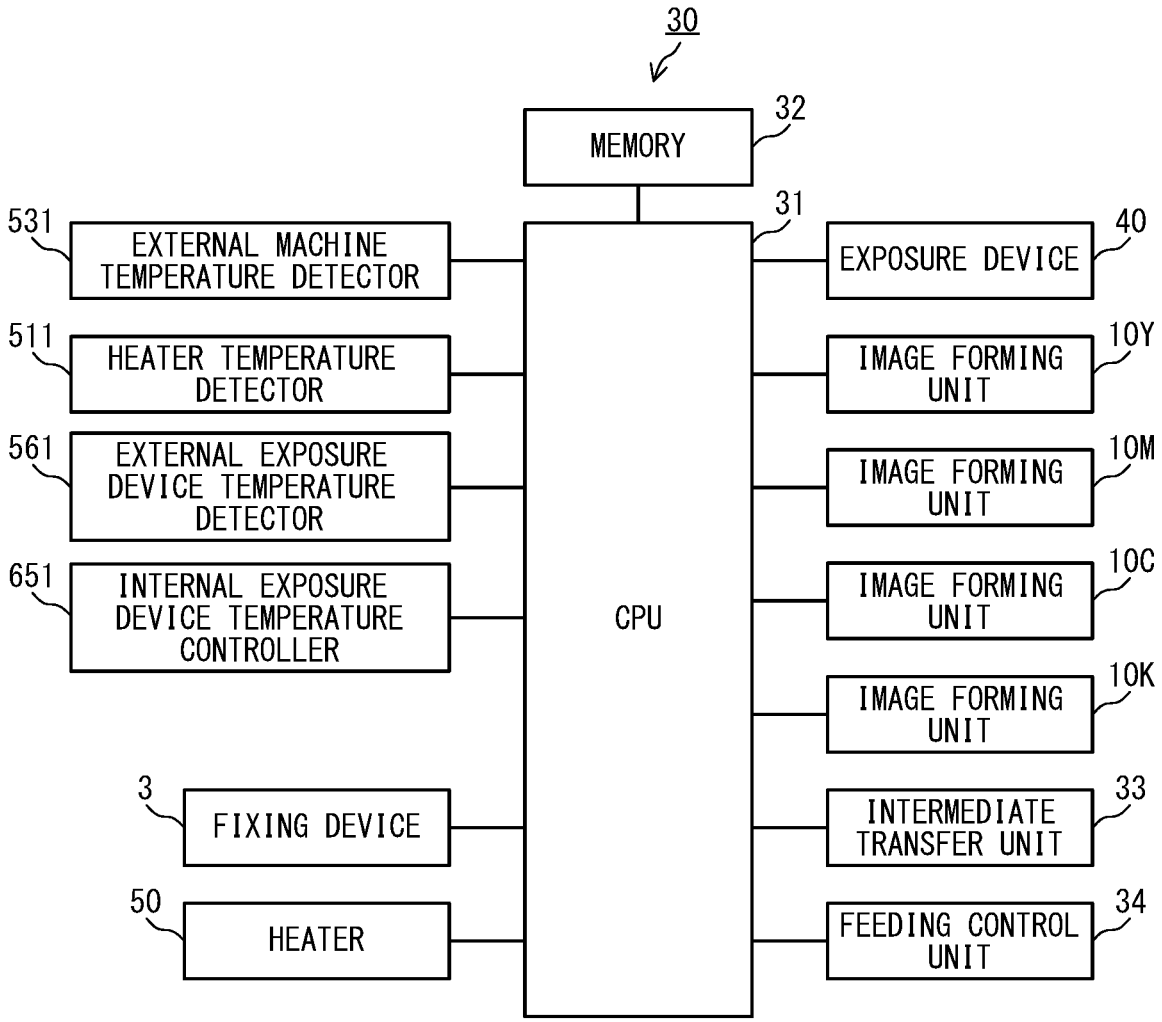
FIG. 3 is a configuration diagram of a controller.

FIG. 3 is a configuration diagram of a controller installed in the image forming apparatus 1. The controller 30 includes a CPU (Central Processing Unit) 31 and a memory 32. The CPU 31 controls the operation of the image forming apparatus 1 by executing a control program stored in the memory 32. The CPU 31 is connected to the exposure device 40, the image forming units 10Y, 10M, 10C and 10K, an intermediate transfer unit 33, a feeding control unit 34, and the fixing device 3. The CPU 31 controls the image forming on the recording material P described in the above by controlling these operations. The intermediate transfer unit 33 performs a rotation control of the intermediate transfer belt 20 by controlling operations of the belt conveyance rollers 21 and 22. Further, the CPU 31 controls the operation of the secondary transfer roller 23 to transfer the toner image from the intermediate transfer belt 20 to the recording material P. The feeding control unit 34 controls an operation of a feeding mechanism to control feeding of the recording material P. CPU 31 performs a temperature control of the heater 50.

When performing a color misregistration correction using a detection image for detecting a color misregistration amount, the CPU 31 forms the detection image on the intermediate transfer belt 20 using the image forming units 10Y, 10M, 10C, and 10K. The detection image formed on the intermediate transfer belt 20 is detected by a sensor (not shown). The CPU 31 detects, with respect to a reference color (yellow), the color misregistration amount of another color (magenta, cyan or black) according to the detection result of the sensor. The CPU 31 performs the color misregistration correction by performing a light emission control of the exposure device 40 according to the detected color misregistration amount. Here, the reference color image corresponds to a first image, and another color image corresponds to the second image. Accordingly, the photosensitive drum 100Y, which corresponds to yellow, functions as a first photosensitive member, and the developing device 13Y functions as a first developing unit that forms a first image. For example, the black photosensitive drum 100K functions as a second photosensitive member, and the black developing device 13K functions as a second developing unit that forms a second image.

The CPU 31 can detect a temperature of the image forming apparatus 1, and can perform the color misregistration correction by predicting the color misregistration amount according to the detected temperature, without using the detection image. For this purpose, the CPU 31 is connected to an external machine temperature detector 531 for detecting an external machine temperature, a heater temperature detector 511, an external exposure device temperature detector 561 (hereinafter "temperature detector 561"), and an internal exposure device temperature controller 651 (hereinafter "temperature controller 651"). Then, when forming an image, the CPU 31 acquires temperature information, and the controller 30 performs image processing on image data based on the color misregistration amount so that the color misregistration of each color image is corrected. The image forming units 10Y, 10M, 10C, and 10K form an image based on the image data on which the image processing is performed by the controller 30. Thereby an image in which color misregistration is suppressed is formed on the recording material P.

The external machine temperature detector 531 acquires a detection result of a temperature detected by the temperature sensor 53, and inputs an external machine temperature to CPU 31. The heater temperature detector 511 acquires a detection result of a temperature detected by the heater 50 by the heater temperature sensor 51, and inputs the heater temperature to CPU 31. The temperature detector 561 acquires the detection result of the temperature of at least one of the temperature sensor 56*a* and the temperature sensor 56*b* and inputs the exposure device outside temperature to the CPU 31. When the detection results are obtained from both the temperature sensor 56*a* and the temperature sensor 56*b*, the temperature detector 561 inputs, for example, as an external exposure device temperature, an average value thereof to the CPU 31. The temperature controller 651 acquires a temperature detection result of the temperature sensor 65 and inputs an internal exposure device temperature to the CPU 31.

The CPU 31 acquires respective detected temperatures from the external machine temperature detector 531, the heater temperature detector 511, the temperature detector 561, and the temperature controller 651. Then, the CPU 31 acquires a predicted value of the color misregistration amount from these temperatures. The CPU 31 calculates the predicted value using a prediction formula that represents a relationship between a temperature and the predicted value of the color misregistration amount. The prediction formula is determined by selecting from a plurality of candidate formulas. That is, the CPU 31 functions as a control unit which controls a misregistration between the image of the reference color and the image of another color, based on the detected temperatures of the temperature sensors 56*a* and 56*b*, the detected temperature of the heater temperature sensor 51, and the detected temperature of the external machine temperature sensor 53. The memory 32 stores a plurality of candidate formulas of a prediction formula. In the following example, the CPU 31 calculates a predicted value of the color misregistration amount using a prediction formula. However, the present invention is not limited to this, and the CPU 31 may acquire the predicted value of the color misregistration amount using a table that represents the relationship between the temperature and the predicted value of the color misregistration amount. In this case, a plurality of table candidates representing the relationship between the temperature and the predicted value of the color misregistration amount are stored in the memory 32. The prediction formula or the table corresponds to a detection condition used for detecting the color misregistration amount.

Prediction of Color Misregistration Amount

The CPU 31 determines a prediction formula for calculating a predicted value of the color misregistration amount from a plurality of candidate formulas according to relationship among the external machine temperature, the external exposure device temperature, and the heater temperature.

Figure 4A:
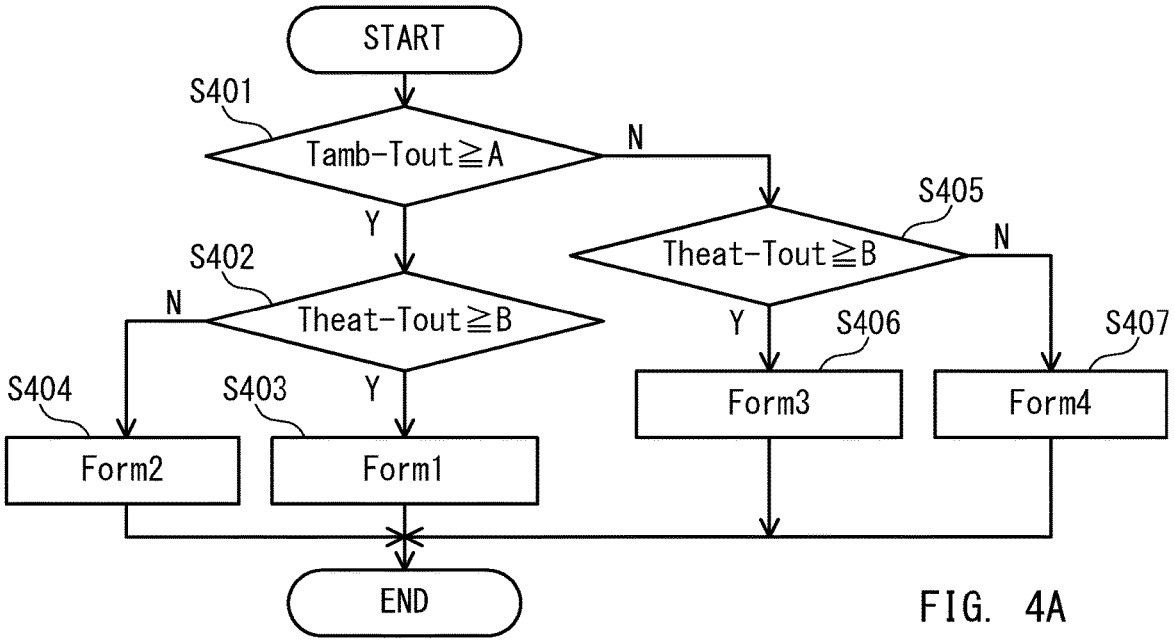
FIG. 4A, FIG. 4B, and FIG. 4C are flow charts representing processing for determining a prediction formula.
Figure 4B:
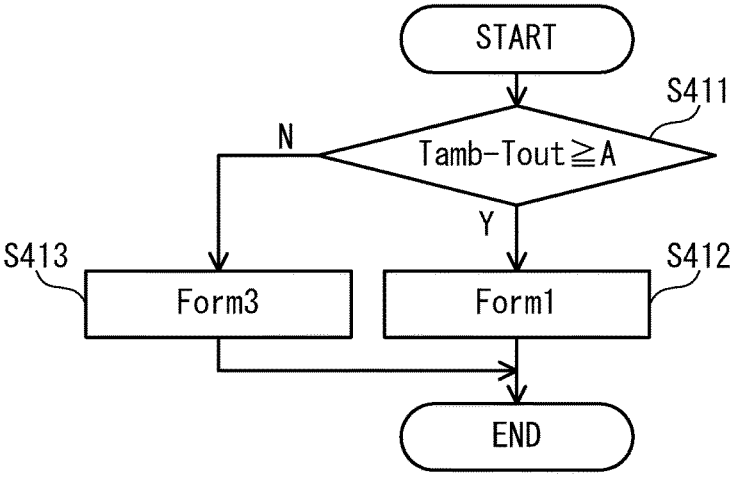
Figure 4C:
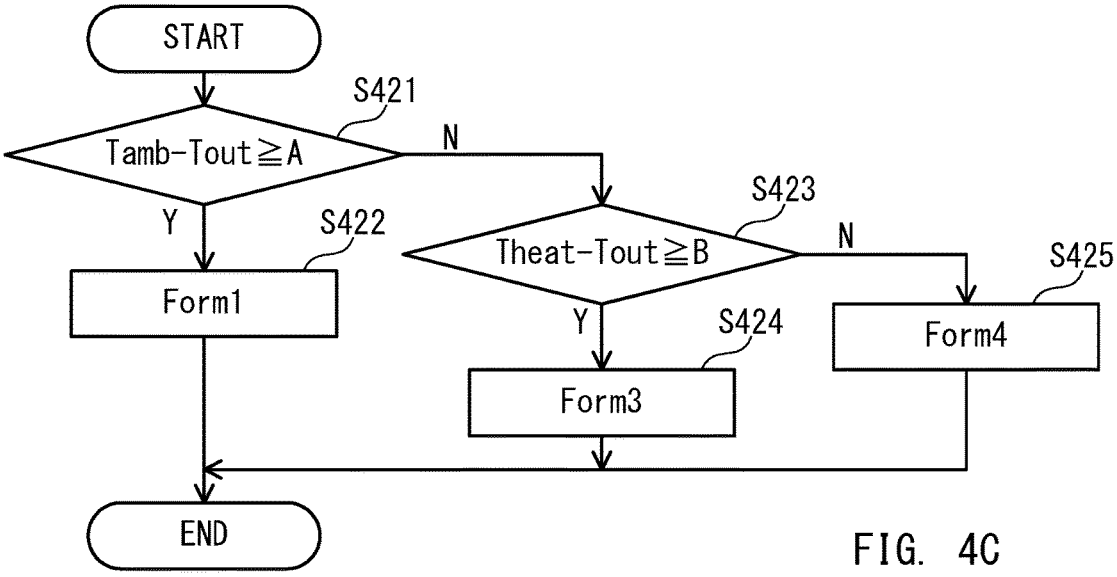

Each of FIG. 4A to FIG. 4C is a flow chart representing processing for determining the prediction formula to be used. FIG. 4A shows processing of determining the prediction formula to be used from four candidate formulas (i.e., first prediction formula: Form 1, second prediction formula: Form 2, third prediction formula: Form 3, and fourth prediction formula: Form 4). FIG. 4B shows processing of determining the prediction formula to be used from two candidate formulas (i.e., first prediction formula: Form 1 and third prediction formula: Form 3). FIG. 4C shows processing of determining the prediction formula to be used from three candidate formulas (i.e., first prediction formula: Form 1, third prediction formula: Form 3, and fourth prediction formula: Form 4). In these flow charts, "Tamb" is the external machine temperature. "Tout" is the external exposure device temperature. "Theat" is the heater temperature.

When determining the prediction formula from the four candidate formulas (FIG. 4A), firstly, the CPU 31 determines whether the value obtained by subtracting the external exposure device temperature Tout from the external machine temperature Tamb is equal to or greater than a threshold value A (Step S401). The threshold value A is "−3.7", for example. When the value obtained by subtracting the exposure device outside temperature Tout from the outside temperature Tamb is equal to or greater than the threshold value A (Step S401: Y), the CPU 31 determines whether or not the value obtained by subtracting the external exposure device temperature Tout from the heater temperature Theat is greater than or equal to the threshold value B (Step S402). The threshold value B is "6.6", for example.

When the value obtained by subtracting the external exposure device temperature Tout from the heater temperature Theat is equal to or greater than the threshold value B (Step S402: Y), the CPU 31 determines the prediction formula for calculating the predicted value of the color misregistration amount as the first prediction formula (Form 1) (Step S403). In the processing of S403, when the external exposure device temperature Tout does not exceed the external machine temperature Tamb by a first temperature difference (i.e., the external exposure device temperature Tout is lower than a sum of both the external machine temperature Tamb and the first temperature difference) and the heater temperature Theat exceeds the external exposure device temperature Tout by a second temperature difference or more, the CPU 31 controls, based on the first prediction formula (Form 1), the color misregistration based on the external exposure device temperature Tout, the heater temperature Theat, and the external machine temperature Tamb.

When the value obtained by subtracting the external exposure device temperature Tout from the heater temperature Theat is lower than the threshold value B (Step S402: N), the CPU 31 determines the prediction formula for calculating the predicted value of the color misregistration amount as the second prediction formula (Form 2) (Step S404). In the processing of S404, when a temperature difference between the external exposure device temperature Tout does not exceed the external machine temperature Tamb by the first temperature difference and the heater temperature Theat does not exceed the external exposure device temperature Tout by a second temperature difference, the CPU 31 controls, based on the second prediction formula (Form 2), the color misregistration based on the external exposure device temperature Tout, the heater temperature Theat, and the external machine temperature Tamb.

When the value obtained by subtracting the exposure device outside temperature Tout from the outside temperature Tamb is lower than the threshold value A (Step S401: N), the CPU 31 determines whether or not the value obtained by subtracting the external exposure device temperature Tout from the heater temperature Theat is greater than or equal to the threshold value B (Step S405). When the value obtained by subtracting the external exposure device temperature Tout from the heater temperature Theat is equal to or greater than the threshold value B (Step S405: Y), the CPU 31 determines the prediction formula for calculating the predicted value of the color misregistration amount as the third prediction formula (Form 3) (Step S406). In the processing of S406, when the external exposure device temperature Tout exceeds the external machine temperature Tamb by the first temperature difference or more and the heater temperature Theat exceeds the external exposure device temperature Tout by the second temperature difference or more, the CPU 31 controls, based on the third prediction formula (Form 3), the color misregistration based on the external exposure device temperature Tout, the heater temperature Theat, and the external machine temperature Tamb.

When the value obtained by subtracting the external exposure device temperature Tout from the heater temperature Theat is lower than the threshold value B (Step S405: N), the CPU 31 determines the prediction formula for calculating the predicted value of the color misregistration amount as the fourth prediction formula (Form 4) (Step S407). In the processing of S407, when the external exposure device temperature Tout exceeds the external machine temperature Tamb by the first temperature difference or more and the heater temperature Theat does not exceed the external exposure device temperature Tout by a second temperature difference, the CPU 31 controls, based on the fourth prediction formula (Form 4), the color misregistration based on the external exposure device temperature Tout, the heater temperature Theat, and the external machine temperature Tamb.

When the external exposure device temperature Tout does not exceed the external machine temperature Tamb by a predetermined temperature and the heater temperature Theat exceeds the external exposure device temperature Tout by another predetermined temperature or more, the CPU 31 determines the first prediction formula (Form 1) as the prediction formula. The predetermined temperature is 3.7° C. (degrees Celsius) and another predetermined temperature is 6.6° C. (degrees Celsius). When the external exposure device temperature Tout does not exceed the external machine temperature Tamb by a predetermined temperature and the heater temperature Theat does not exceed the external exposure device temperature Tout by another predetermined temperature, the CPU 31 determines the second prediction formula (Form 2) as the prediction formula. When the external exposure device temperature Tout exceeds the external machine temperature Tamb by the predetermined temperature or more and the heater temperature Theat exceeds the external exposure device temperature Tout by another predetermined temperature or more, the CPU 31 determines the third prediction formula (Form 3) as the prediction formula. When the external exposure device temperature Tout exceeds the external machine temperature Tamb by a predetermined temperature or more and a difference between the heater temperature Theat and the external exposure device temperature Tout does not exceed another predetermined temperature, the CPU 31 determines the fourth prediction formula (Form 4) as the prediction formula.

When determining the prediction formula from the two candidate formulas (FIG. 4B), firstly, the CPU 31 determines whether the value obtained by subtracting the external exposure device temperature Tout from the external machine temperature Tamb is equal to or greater than a threshold value A (Step S411). When the value obtained by subtracting the external exposure device temperature Tout from the external machine temperature Tamb is equal to or greater than the threshold value A (Step S411: Y), the CPU 31 determines the prediction formula for calculating the predicted value of the color misregistration amount as the first prediction formula (Form 1) (Step S412). In the processing of S412, when the external exposure device temperature Tout does not exceed the external machine temperature Tamb by the predetermined temperature, the CPU 31 controls, based on the first prediction formula (Form 1), the color misregistration based on the external exposure device temperature Tout, the heater temperature Theat, and the external machine temperature Tamb.

When the value obtained by subtracting the external exposure device temperature Tout from the external machine temperature Tamb is lower than the threshold value A (Step S411: N), the CPU 31 determines the prediction formula for calculating the predicted value of the color misregistration amount as the third prediction formula (Form 3) (Step S413). In the processing of S413, when the external exposure device temperature Tout exceeds the external machine temperature Tamb by the predetermined temperature or more, the CPU 31 controls, based on the third prediction formula (Form 3), the color misregistration based on the external exposure device temperature Tout, the heater temperature Theat, and the external machine temperature Tamb.

When the external exposure device temperature Tout does not exceed the external machine temperature Tamb by the predetermined temperature, the CPU 31 determines the first prediction formula (Form 1) as the prediction formula. When the external exposure device temperature Tout exceeds the external machine temperature Tamb by the predetermined temperature or more, the CPU 31 determines the second prediction formula (Form 2) as the prediction formula.

When determining the prediction formula from the three candidate formulas (FIG. 4C), firstly, the CPU 31 determines whether the value obtained by subtracting the external exposure device temperature Tout from the external machine temperature Tamb is equal to or greater than a threshold value A (Step S421). When the value obtained by subtracting the external exposure device temperature Tout from the external machine temperature Tamb is equal to or greater than the threshold value A (Step S421: Y), the CPU 31 determines the prediction formula for calculating the predicted value of the color misregistration amount as the first prediction formula (Form 1) (Step S422). In the processing of S422, when the external exposure device temperature Tout does not exceed the external machine temperature Tamb by the first temperature difference, the CPU 31 controls, based on the first prediction formula (Form 1), the color misregistration based on the external exposure device temperature Tout, the heater temperature Theat, and the external machine temperature Tamb.

When the value obtained by subtracting the external exposure device temperature Tout from the external machine temperature Tamb is lower than the threshold value A (Step S421: N), the CPU 31 determines whether or not the value obtained by subtracting the external exposure device temperature Tout from the heater temperature Theat is greater than or equal to the threshold value B (Step S423).

When the value obtained by subtracting the external exposure device temperature Tout from the heater temperature Theat is equal to or greater than the threshold value B (Step S423: Y), the CPU 31 determines the prediction formula for calculating the predicted value of the color misregistration amount as the third prediction formula (Form 3) (Step S424). In the processing of S424, when the external exposure device temperature Tout exceeds the external machine temperature Tamb by the first temperature difference or more and the heater temperature Theat exceeds the external exposure device temperature Tout by the second temperature difference or more, the CPU 31 controls, based on the third prediction formula (Form 3), the color misregistration based on the external exposure device temperature Tout, the heater temperature Theat, and the external machine temperature Tamb.

When the value obtained by subtracting the external exposure device temperature Tout from the heater temperature Theat is lower than the threshold value B (Step S423: N), the CPU 31 determines the prediction formula for calculating the predicted value of the color misregistration amount as the fourth prediction formula (Form 4) (Step S425). In the processing of S425, when the external exposure device temperature Tout exceeds the external machine temperature Tamb by the first temperature difference or more and the heater temperature Theat does not exceed the external exposure device temperature Tout by the second temperature difference, the CPU 31 controls, based on the fourth prediction formula (Form 4), the color misregistration based on the external exposure device temperature Tout, the heater temperature Theat, and the external machine temperature Tamb.

When the external exposure device temperature Tout does not exceed the external machine temperature Tamb by the first temperature difference, the CPU 31 determines the first prediction formula (Form 1) as the prediction formula. When the external exposure device temperature Tout exceeds the external machine temperature Tamb by the first temperature difference or more and the heater temperature Theat exceeds the external exposure device temperature Tout by the second temperature difference or more, the CPU 31 determines the second prediction formula (Form 2) as the prediction formula. When the external exposure device temperature Tout exceeds the external machine temperature Tamb by the first temperature difference or more and the heater temperature Theat does not exceed the external exposure device temperature Tout by the second temperature difference, the CPU 31 determines the third prediction formula (Form 3) as the prediction formula.

As described above, the CPU 31 determines the prediction formula according to whether each of the temperature differences among the external machine temperature Tamb, the external exposure device temperature Tout, and the heater temperature Theat is equal to or greater than a threshold value, or less than the threshold value. Examples of the first to fourth prediction formulas that are candidate formulas are as follows.

$$Lb=F1*Theat+F2*(Theat-Tout)+F3*(Tamb-Tout)+F4*Tamb*(Theat-Tout)+F5*Tamb*(Tamb-Tout)+F6*Theat*(Theat-Tout)+F7*Theat*(Tamb-Tout)+F8*(Theat-Tout)*(Tamb-Tout) \quad \text{First prediction formula (Form 1):}$$

This equation represents the predicted value of the color misregistration amount (Lb) of black with respect to the reference color (yellow). "F1" to "F8" are constants.

$$Lm=G1*Theat+G2*(Theat-Tout)+G3*(Tamb-Tout)+G4*Tamb*(Theat-Tout)+G5*Tamb*(Tamb-Tout)+G6*Theat*(Theat-Tout)+G7*Theat*(Tamb-Tout)+G8*(Theat-Tout)*(Tamb-Tout)$$

This equation represents the predicted value of the color misregistration amount (Lm) of magenta with respect to the reference color (yellow). "G1" to "G8" are constants.

$$Lc=H1*Theat+H2*(Theat-Tout)+H3*(Tamb-Tout)+H4*Tamb*(Theat-Tout)+H5*Tamb*(Tamb-Tout)+H6*Theat*(Theat-Tout)+H7*Theat*(Tamb-Tout)+H8*(Theat-Tout)*(Tamb-Tout)$$

This equation represents the predicted value of the color misregistration amount (Lc) of cyan with respect to the reference color (yellow). "H1" to "H8" are constants.

The set of the above three formulas is the first prediction formula (Form 1). The constants F1 to F8, G1 to G8, and H1 to H8 in each formula can be either positive or negative values. The second prediction formula (Form 2), the third prediction formula (Form 3), and the fourth prediction formula (Form 4) are basically the same formula except that the constants F1 to F8, G1 to G8, and H1 to H8 are different from each other.

The first to fourth prediction formulas are not limited to the above as long as they are formulas using combinations selected from the external machine temperature Tamb, the external exposure device temperature Tout, and the heater temperature Theat. The prediction formula of the predicted value of the color misregistration amount may be optimized considering arrangements of components of the image forming apparatus 1, installation environment conditions, individual differences of the components, and the like, thereby it is possible to achieve an accurate color misregistration correction. Further, the prediction formula may be configured to further include a term of the exposure device internal temperature. With this configuration, the prediction accuracy can be further improved.

Figure 5:
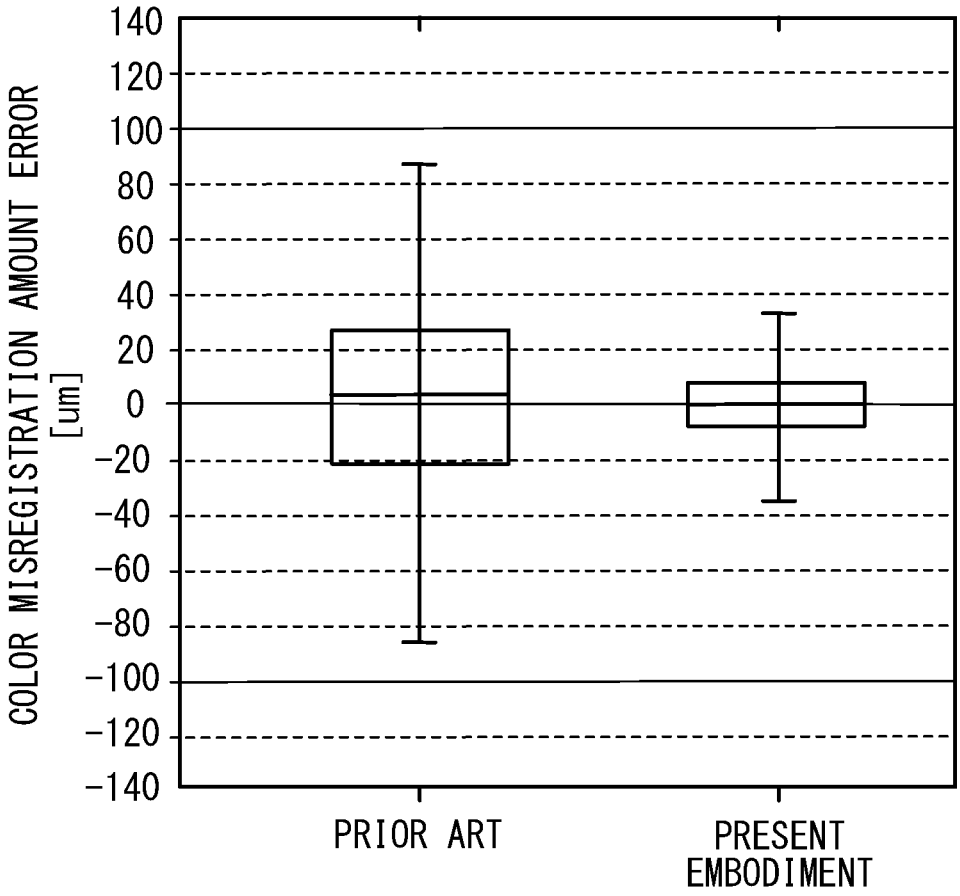
FIG. 5 is a box-and-whisker diagram representing distribution of a color misregistration amount error.

FIG. 5 is a box-and-whisker diagram showing distribution of the difference between the predicted value of the color misregistration amount and the actual measurement value of the color misregistration amount (color misregistration amount error). The actual measurement value of the color misregistration amount is a color registration amount which is detected using the detection image. This box-and-whisker shows that 95% of data is included in the range between the upper and lower horizontal bars. It is noted that "present embodiment" represents the distribution of errors between the predicted value of the color misregistration amount, which is calculated using the above prediction formula and the actual measurement value of the color misregistration amount. Further, "prior art" represents the distribution of color misregistration errors between the predicted value of the color misregistration amount, which is calculated using a prior prediction formula and the actual measurement value of the color misregistration amount. The color misregistration amount error when the predicted value of the color misregistration amount according to "present embodiment" is used is almost half of the color misregistration amount error when the predicted value of the color misregistration amount according to "prior art" is used. That is, FIG. 5 shows that, by using the prediction formula of the present embodiment, the difference between the predicted value and the actual measurement value of the color misregistration amount is decreased as compared with the prior art, thereby the effect of the color misregistration correction is improved.

In the above description, the prediction formula to be used is determined based on the detection results of the temperature sensors 56*a* and 56*b*, and the predicted value of the color misregistration amount is calculated. The external exposure device temperature Tout is an ambient temperature around the exposure device 40. The external exposure device temperature Tout may be detected by a temperature sensor provided in the image forming unit 10. For example, the CPU 31 uses, for performing the above processing, the detection results of the image forming unit temperature sensor 57*a* provided in the image forming unit housing 11 and the image forming unit temperature sensor 57*b* provided in the developing device 13 for the external exposure device temperature Tout.

In this case, the temperature detector 561 acquires the detection result of the temperature of at least one of the image forming unit temperature sensor 57*a* and the image forming unit temperature sensor 57*b*, and inputs the external exposure device temperature Tout to the CPU 31. Further, when acquiring detection results of both the image forming unit temperature sensor 57*a* and the image forming unit temperature sensor 57*b*, the temperature detector 561 inputs the average value thereof to the CPU 31 as the external exposure device temperature Tout, for example. Further, the temperature detector 561 can input combinations among the detection results of the temperature sensor 56*a*, the temperature sensor 56*b*, the image forming unit temperature sensor 57*a*, and image forming unit temperature sensor 57*b* to the CPU 31 as the external exposure device temperature Tout.

The CPU 31 selects and determines the prediction formula from a plurality of candidate formulas. The smaller the number of prediction formula candidates, the smaller the capacity for storing the prediction formulas in the memory 32, thereby processing for determining the prediction formula becomes easy. As the number of the prediction formula candidates increases, the color misregistration amount error between the predicted value of the color misregistration amount and the actually measured color misregistration amount will decrease.

According to the image forming apparatus 1, because the CPU 31 uses the temperature detected by the heater temperature sensor 51 (heater temperature: Theat) to predict the color misregistration amount, in a configuration in which the heater 50 is provided between the photosensitive drum 100 and the exposure device 40, the color misregistration amount can be predicted with high accuracy. Further, the CPU 31 determines a prediction formula based on the external exposure device temperature Tout, and predicts the color misregistration amount, based on prediction formula, from the external exposure device temperature Tout, the heater temperature Theat, and the external machine temperature Tamb. Therefore, a complicated color misregistration amount caused by the external machine temperature and a temperature of the exposure device 40, and the heat generated by the heater 50 can be predicted with high accuracy.

Note that the reference color of the image forming apparatus 1 is not limited to yellow. In the image forming apparatus 1, the reference color may be black, for example. In this case, the yellow, magenta, and cyan image forming positions are adjusted with respect to the black image forming position. Further, the image forming apparatus 1 may be configured to include a photosensitive belt instead of the photosensitive drum 100. The photosensitive drum and the photosensitive belt function as a photosensitive member on which an electrostatic latent image is formed. Further, the charger 12 may be a charging roller that contacts a photosensitive member, or a charging wire which does not contact the photosensitive member.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-190757, filed Oct. 9, 2018, which is hereby incorporated by reference herein in its entirety.

What is claimed is:

1. An image forming apparatus comprising:

a first photosensitive member;

a charging unit configured to charge the first photosensitive member;

a laser scanner configured to expose the first photosensitive member charged by the charging unit to form an electrostatic latent image, wherein the laser scanner has a light source, an optical part that deflects light from the light source to expose the first photosensitive member, and a housing that houses the optical part; and a developing unit configured to develop the electrostatic latent image on the first photosensitive member with toner of a first color, a second photosensitive member on which a second image is developed with toner of a second color different from a first image developed with the toner of the first color;

a transfer unit configured to transfer the first image and the second image onto a sheet;

a fixing unit configured to fix the first image and the second image to the sheet;

a photosensitive member heater configured to heat the first photosensitive member and the second photosensitive member;

a first temperature sensor provided on the laser scanner, and configured to detect a laser scanner temperature;

a second temperature sensor configured to detect a heater temperature of the photosensitive member heater;

a third temperature sensor, wherein a distance between the third temperature sensor and the photosensitive member heater is greater than a distance between the second temperature sensor and the photosensitive member heater; and a controller configured to:

determine, in a case in which the heater temperature does not exceed the laser scanner temperature by a predetermined temperature differential, a color misregistration from the laser scanner temperature, the heater temperature, and the temperature detected by the third temperature sensor based on a first formula having a first coefficient;

determine, in a case in which the heater temperature exceeds the laser scanner temperature by the predetermined temperature differential or more, the color misregistration from the laser scanner temperature, the heater temperature, and the temperature detected by the third temperature sensor based on a second formula having a second coefficient different from the first coefficient; and control a relative position between the first image to be formed and the second image to be formed based on the determined color misregistration.

2. The image forming apparatus according to claim 1, wherein the photosensitive member heater is provided between the first photosensitive member and the housing.

3. The image forming apparatus according to claim 1, wherein the controller controls the temperature of the photosensitive member heater based on the heater temperature detected by the second temperature sensor.

4. The image forming apparatus according to claim 1, wherein the laser scanner includes a circuit board configured to control the light source;

wherein the circuit board is embodied at an outside portion of the housing; and wherein the first temperature sensor is provided on the circuit board.

5. The image forming apparatus according to claim 1, wherein the laser scanner has another light source, wherein the laser scanner exposes the second photosensitive member with light from the other light source to form an electrostatic latent image on the second photosensitive member, and wherein the electrostatic latent image on the second photosensitive member is developed with the toner of the second color.

6. The image forming apparatus according to claim 1, wherein, in the first formula, a difference between the laser scanner temperature and the temperature detected by the third temperature sensor is multiplied by the first coefficient, and wherein, in the second formula, a difference between the laser scanner temperature and the temperature detected by the third temperature sensor is multiplied by the second coefficient.

* * * * *